US005718294A

United States Patent [19]

Billiard et al.

[11] Patent Number: 5,718,294

[45] Date of Patent: Feb. 17, 1998

[54] FIRE SUPPRESSION OR EXPLOSION PROTECTION SYSTEM HAVING A MANUAL ACTUATOR FOR AN ELECTRICALLY RESPONSIVE INITIATOR OR GAS-GENERATING CARTRIDGE ACTIVATOR

[75] Inventors: Gregory J. Billiard, Lenexa, Kans.; Bradford T. Stilwell, Blue Springs, Mo.; Sean P. Titus, Independence, Mo.; Edward Charles Ellis, Jr., Lee's Summit, Mo.

[73] Assignee: Fike Corporation, Blue Springs, Mo.

[21] Appl. No.: 717,412

[22] Filed: Sep. 20, 1996

[51] Int. Cl.[6] ..... A62C 37/00

[52] U.S. Cl. ..... 169/61; 169/28; 169/DIG. 3; 310/41

[58] Field of Search ..... 169/28, 61, DIG. 3; 310/41

[56] References Cited

U.S. PATENT DOCUMENTS

| | | | |
|---|---|---|---|
| 2,027,944 | 1/1936 | Whitehead et al. | 310/41 |
| 4,199,029 | 4/1980 | Marek . | |
| 4,213,567 | 7/1980 | McIntire . | |
| 4,328,867 | 5/1982 | Heath | 169/28 |
| 4,351,393 | 9/1982 | Tyree . | |
| 4,760,886 | 8/1988 | Sassier | 169/28 |
| 4,779,683 | 10/1988 | Enk | 169/28 |
| 5,031,701 | 7/1991 | McLelland et al. | 169/28 |
| 5,199,500 | 4/1993 | Norman et al. . | |

*Primary Examiner*—Gary C. Hoge

*Attorney, Agent, or Firm*—Hovey, Williams, Timmons & Collins

[57] ABSTRACT

A fire suppression or explosion protection system is having a manual actuator for an electrically responsive initiator or gas-generating cartridge activator. The manually operated actuator (10) for triggering the electrically responsive initiator (26) or gas-generating cartridge activator (17) includes a shaft (46), for generating a current for delivery to the initiator (26) or cartridge activator (17) when the shaft (46) is rotated; a manually moveable handle (38) shiftable between first and second positions at any desired speed; and structure (40) operably coupling the handle (38) with the shaft (46) for rotating the shaft (46) at a selected speed when the handle (38) is shifted between the first and second positions regardless of the speed at which the handle (38) is shifted for generating a current pulse of a selected magnitude for triggering the initiator (26) or gas-generating cartridge activator (17). The gas cartridge activator includes a tubular unit (45) which confines a quantity of smokeless powder granules and has an outermost discharge end normally sealed by a non-fragmenting closure (77) which is vaporized upon ignition of the smokeless powder. The products of combustion from the smokeless powder serve to rupture a rupture disc controlling release of the fire or explosion suppressant.

17 Claims, 6 Drawing Sheets

FIRE SUPPRESSION OR EXPLOSION PROTECTION SYSTEM HAVING A MANUAL ACTUATOR FOR AN ELECTRICALLY RESPONSIVE INITIATOR OR GAS-GENERATING CARTRIDGE ACTIVATOR

BACKGROUND OF THE INVENTION

1. Field of the Invention

The present invention relates to fire suppression and explosion protection systems for suppressing fires and preventing explosions in protected areas such as enclosed rooms. More particularly, the invention relates to a manually operated actuator for generating an electrical triggering current for triggering an electrically responsive device such as an initiator or a gas-generating cartridge activator in a fire suppression or explosion protection system.

2. Description of the Prior Art

Fire suppression and explosion protection systems are commonly installed in industrial and commercial areas for suppressing fires and preventing explosions in the protected areas. Typical fire suppression and explosion protection systems include a number of containers having pressurized suppressant material stored therein and spaced throughout the protected area. Each of the containers includes a release device such as a rupture disc for retaining the pressurized material in the container.

Each of the containers also includes an electrically responsive initiator such as a blasting cap that ruptures its respective release rupture disc in response to the receipt of an electrical triggering current. The triggering current is typically provided by a control panel that is responsive to a number of combustion event detection devices such as smoke, infrared, ion, pressure and UV detectors. The control panel automatically triggers the initiators to rupture the release valves and therefore release the pressurized suppressant material the containers whenever any of the detection devices detects hazardous conditions associated with a fire or explosion in the protected area.

Although designed to be substantially fail-safe, fire suppression and explosion protection systems sometimes fail because their control panels or combustion event detectors lose power or the wiring between the smoke detectors and the control panel or the wiring between the control panel and the initiator becomes damaged. Additionally, smoke detectors and other detection devices sometimes fail to detect hazardous conditions quickly enough.

Due to these problems, many building codes require that fire suppression and explosion protection systems be provided with manually operated actuators for triggering the initiators. Known manually operated actuators are generally of two types. The first type is merely a manual switch coupled with the control and configured for tripping a contact within the control panel whenever a person operates the switch. Unfortunately, this type of manual switch does not provide a true backup to the control panel because it derives its operating power from the control panel. Therefore, if the control panel fails, the manual switch also fails.

The second known type of manually operated actuator includes a manual switch coupled with an emergency battery or a second independent AC power source. The switch delivers a triggering current from the battery to the initiators whenever the switch is activated. Although this type of manual actuator provides a true backup switch that is independent of the control panel, it is expensive to construct and install because it requires the use of a separate power source and the associated wiring coupling the power source to the initiators. This type of manual actuator also requires more maintenance because the emergency batteries or other independent power source must be continually tested and periodically replaced to insure proper operation.

Those skilled in the art will appreciate that these problems are not unique to fire suppression and explosion protection systems but occur in all that require an electrical triggering signal to trigger an electrically responsive device.

OBJECTS AND SUMMARY OF THE INVENTION

In view of the above-described limitations, it is an object of the present invention to provide an improved manually operated actuator for generating an electrical triggering current that does not require its own separate electrical power source such as an emergency battery.

It is also an object of the present invention to provide an improved fire suppression and explosion protection system that includes a manually operated actuator that generates a triggering current completely independently of the system's control panel for triggering the system's initiators, whether of the blasting cap or gas-generating cartridge activator type, whenever a person senses a hazardous condition in the protected area and operates the actuator.

In view of these objects and other objects that become evident from the following description of a preferred embodiment of the invention, an improved manually operated actuator for generating an electrical triggering signal for triggering an electrical responsive device is provided. An improved fire suppression and explosion protection system having a manually operated actuator that generates a triggering current completely independently of the system's control panel is also provided.

The manually operated actuator of the present invention broadly includes generating means, a manually moveable handle shiftable between first and second positions, and means for operably coupling the handle to the generating means. The generating means includes a shaft and is operable for generating a current for delivery to the electrically responsive device when the shaft is rotated. The coupling means operably couples the handle with the shaft for rotating the shaft at a selected and fixed speed when the handle is shifted between its first and second positions regardless of the speed at which the handle is shifted. This permits the generating means to generate a current pulse in a selected magnitude range for delivery to and triggering of the electrically responsive device.

The preferred coupling means includes an over-center spring mechanism operably coupled between the handle and the shaft. When the handle is initially shifted from its first position towards its second position, the spring mechanism is compressed and thus stores a portion of the mechanical force exerted on the handle. Then, during the travel of the handle towards its second position, the compressed spring mechanism is released or expanded for delivering the force stored in the spring mechanism to the shaft of the generator for rapidly rotating the shaft at the selected speed to generate an electrical triggering current pulse of the selected magnitude.

The fire suppression and explosion protection system of the present invention broadly includes at least one container having pressurized suppressant material stored therein, an electrically responsive initiator such as a blasting cap or a gas-generating cartridge activator coupled with the container and a manually operated actuator constructed as described above. The container includes structure such as a rupture disc for holding the suppressant material in the container. The initiator is operably associated with the release rupture disc for effecting rupture of the disc when an electrical triggering current is directed to the initiator. The manually operated actuator generates the triggering current as described above for triggering the initiator.

By constructing a manually operated actuator as described above, numerous advantages are realized. For example, by providing the actuator with a manually operated generating means, the electrical triggering current needed to trigger the electrically responsive devices can be manually generated. This eliminates the need for separate electrical energy storage devices such as batteries.

Moreover, by providing the manually operated actuator with means for rotating the shaft at a selected speed regardless of the speed at which the handle is shifted or the amount of force exerted on the handle, the generating means can generate a triggering current pulse in a selected magnitude range regardless of the speed at which the person shifts the handle. This permits the actuator to generate a triggering current pulse of sufficient magnitude to trigger the electrically responsive devices regardless of the strength of the person who operates the actuator.

Similarly, by constructing a fire suppression and explosion protection system as described above, numerous advantages are realized. For example, by providing the system with a manually operated actuator that triggers the initiators of the system completely independently of the control panel and the sensors, the fire suppression and explosion protection is provided with a true manual backup actuator that allows the system to be operated even when the control panel or the sensors lose power or otherwise fail.

The improved gas-generating cartridge activator for rupturing the rupture disc which retains a suppressant medium under pressure in an enclosure therefor includes a tubular cartridge body unit having a discharge end and that stores granules of smokeless powder. A non-fragmenting Mylar disc seals the discharge end of the tubular body unit. A disc of an initiator mix is embedded in the granules of smokeless powder and is electrically connected to the source of triggering current. Upon actuation of the generator by direction of a current to the initiator disc, the smokeless powder is ignited producing hot products of combustion which vaporize the Mylar disc and are discharged through the open end of the cartridge body. The volume and pressure wave of the products of combustion exiting from the cartridge body unit are sufficient to open the rupture disc that normally retains the pressurized suppressant in the enclosure therefor to release the suppressant for delivery to a combustion event such as a fire or explosion.

By virtue of the utilization of smokeless powder as the propellant medium within the cartridge, the products of combustion resulting from ignition of the smokeless powder are adequate to immediately initiate release of the suppressant from the storage container therefor, but the burning of the smokeless powder does not take place at a rate to create an explosion which ruptures or fragments the cartridge body. Furthermore, utilization of non-fragmenting closure for the cartridge body such as a Mylar disc prevents dissemination of metal fragments downstream of the cartridge because the Mylar is completely volatilized by the hot products of combustion from the burning smokeless powder.

The gas generator cartridge activator of this invention for initiating release of suppressant from the storage container therefor qualifies for a lower hazardous material category under DOT and UN transportation standards, thus permitting shipment of the activators at lower rates and through common carriers which is not the case with blasting cap initiators that come within the most hazardous of the transportation ratings promulgated by DOT and the UN.

BRIEF DESCRIPTION OF THE DRAWING FIGURES

DETAILED DESCRIPTION OF PREFERRED EMBODIMENT

Figure 1:
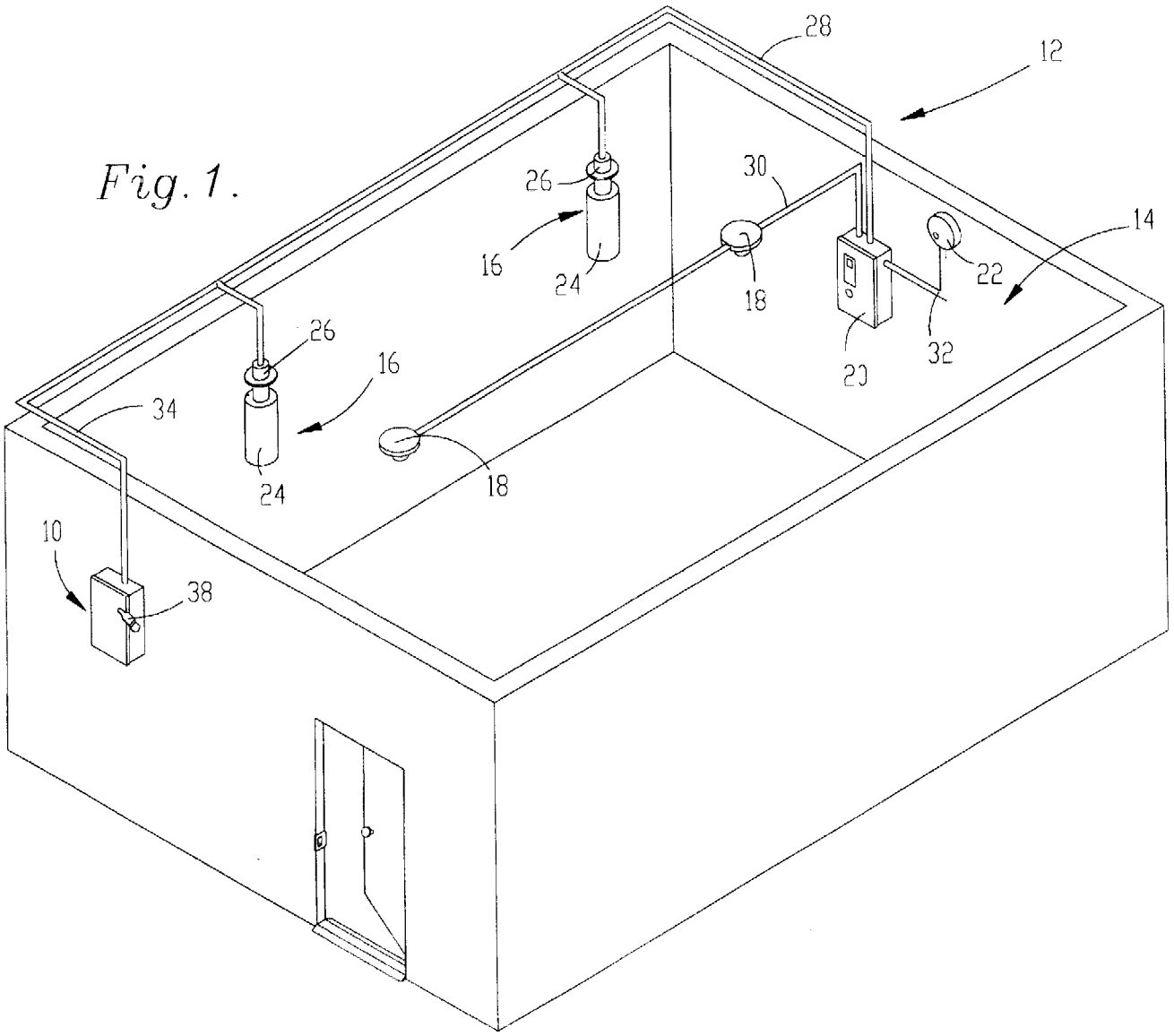
FIG. 1 is an isometric view of a room having a fire protection system constructed in accordance with one preferred embodiment of the invention installed therein.
Figure 3:
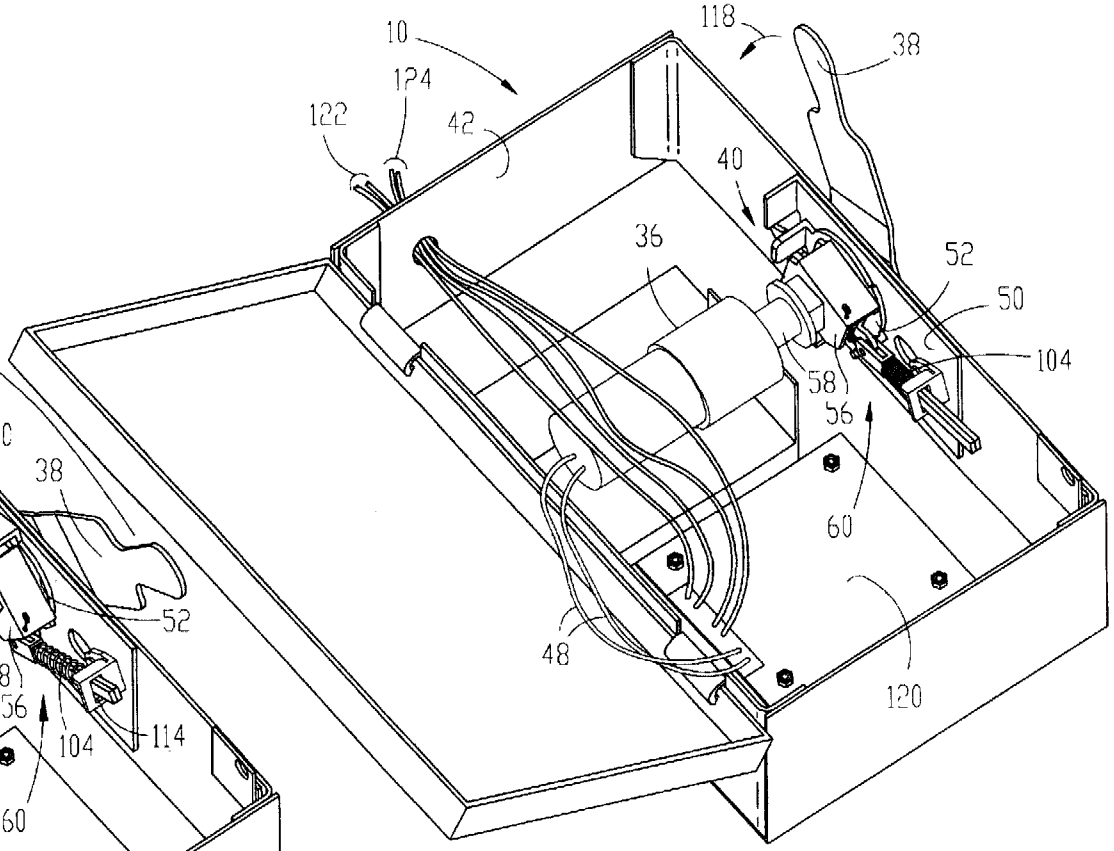
FIG. 3 is a perspective view of the manually operated actuator in an intermediate position.
Figure 2:
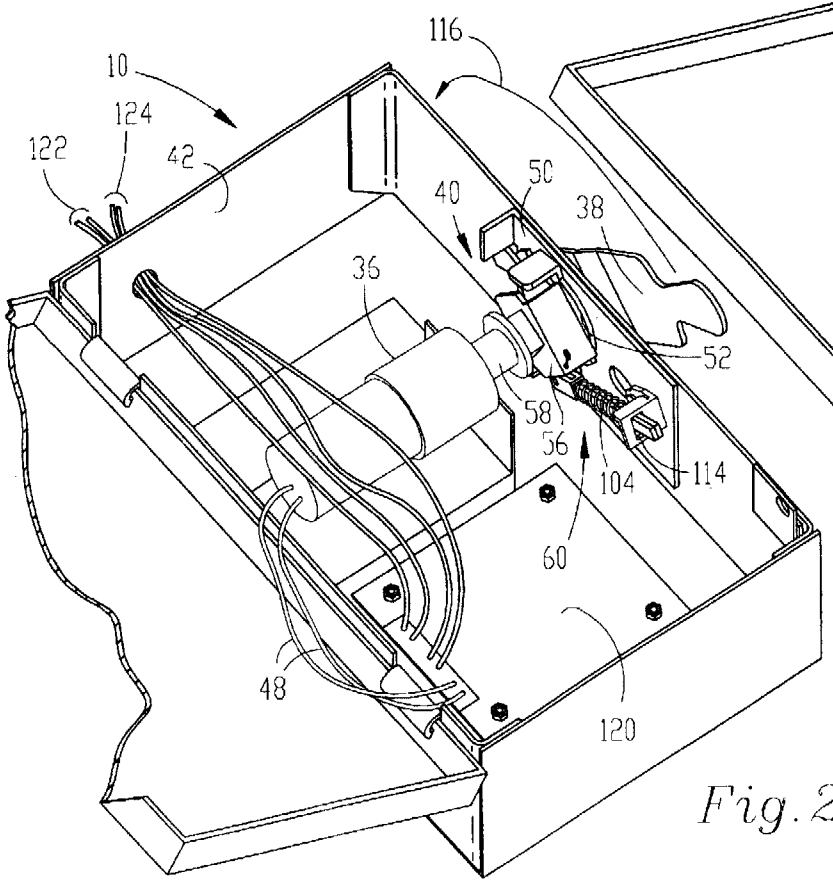
FIG. 2 is a perspective view of a manually operated actuator constructed in accordance with a preferred embodiment of the invention showing the actuator in a first, non-activated position.
Figures 4, 11:
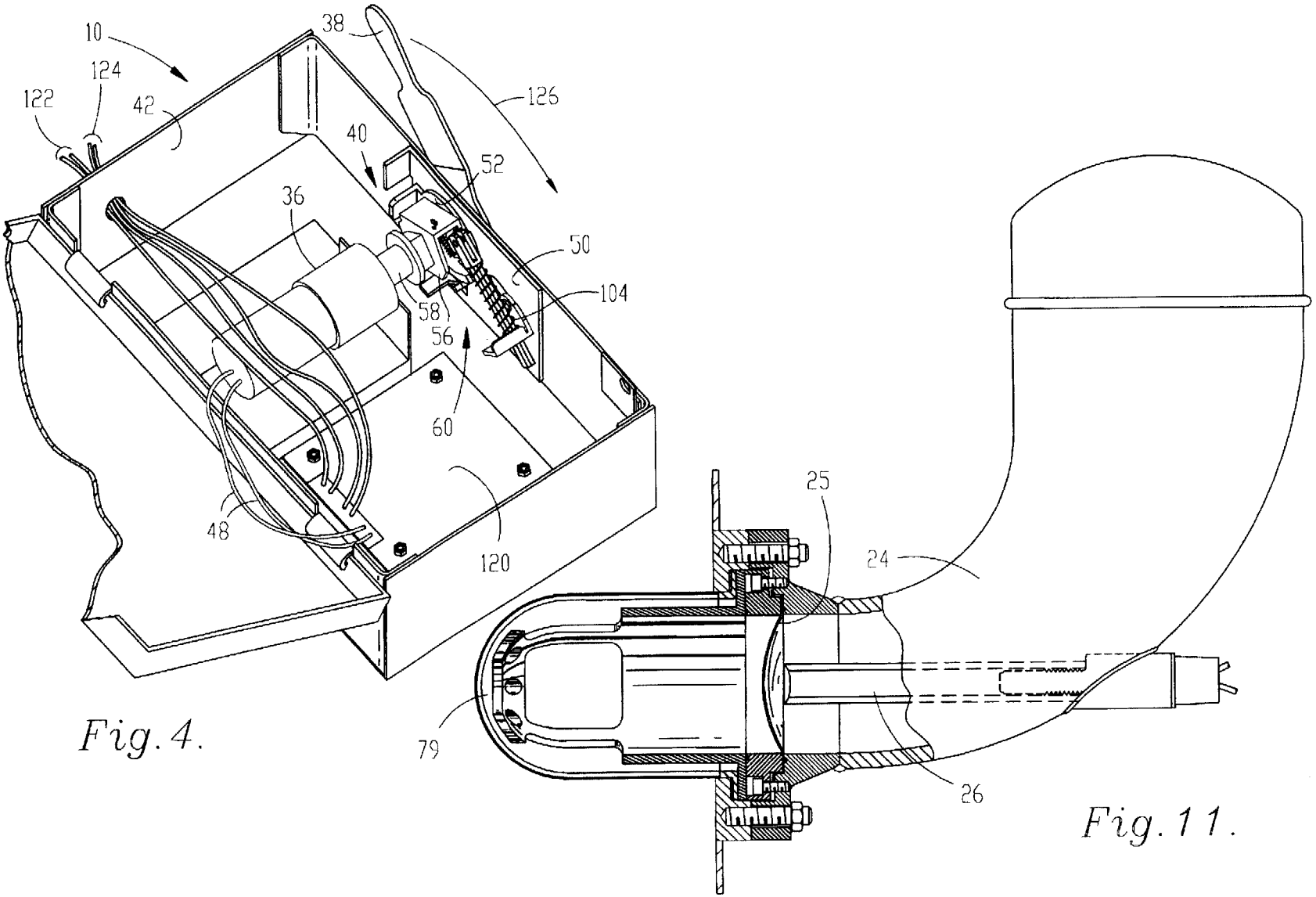
FIG. 4 is a perspective view of the manually operated actuator in a second, activated position.
FIG. 11 is a side elevational view in partial section of an explosion suppression unit constructed in accordance with this invention and incorporating a gas-generating cartridge unit as depicted in FIGS. 6 and 7.

Turning now to the drawing figures, and particularly FIGS. 2–4, a manually operated actuator 10 constructed in accordance with a preferred embodiment of the invention is illustrated. As best illustrated in FIG. 1, the actuator 10 is preferably coupled with a fire suppression or explosion protection system broadly referred to by the numeral 12. The fire suppression or explosion protection system 12 is positioned in a protected zone such as a room 14 and includes a plurality of fire suppressant releasing units 16 such as rupture discs, a plurality of combustion event sensing devices 18 for sensing an incipient fire or explosion, a main control panel 20, and a visual or audible alarm device 22. As described in more detail below, the manually operated actuator 10 provides a manually generated electrical triggering pulse or signal to the initiators 26 such as blasting caps or gas-generating cartridge activators that is completely independent of the operation of the sensing devices 18 and the main control panel 20.

The fire suppressant releasing units 16 are spaced throughout the protected room 14 and each includes a container portion 24 and an electrically responsive initiator portion 26. Each container portion 24 holds a quantity of pressurized suppressant material therein and includes an internal rupture disc for retaining the pressurized suppressant in the container. A preferred suppressant for fire suppression is heptafluoropropane (FM200, Great Lakes Chemical).

Figure 6:
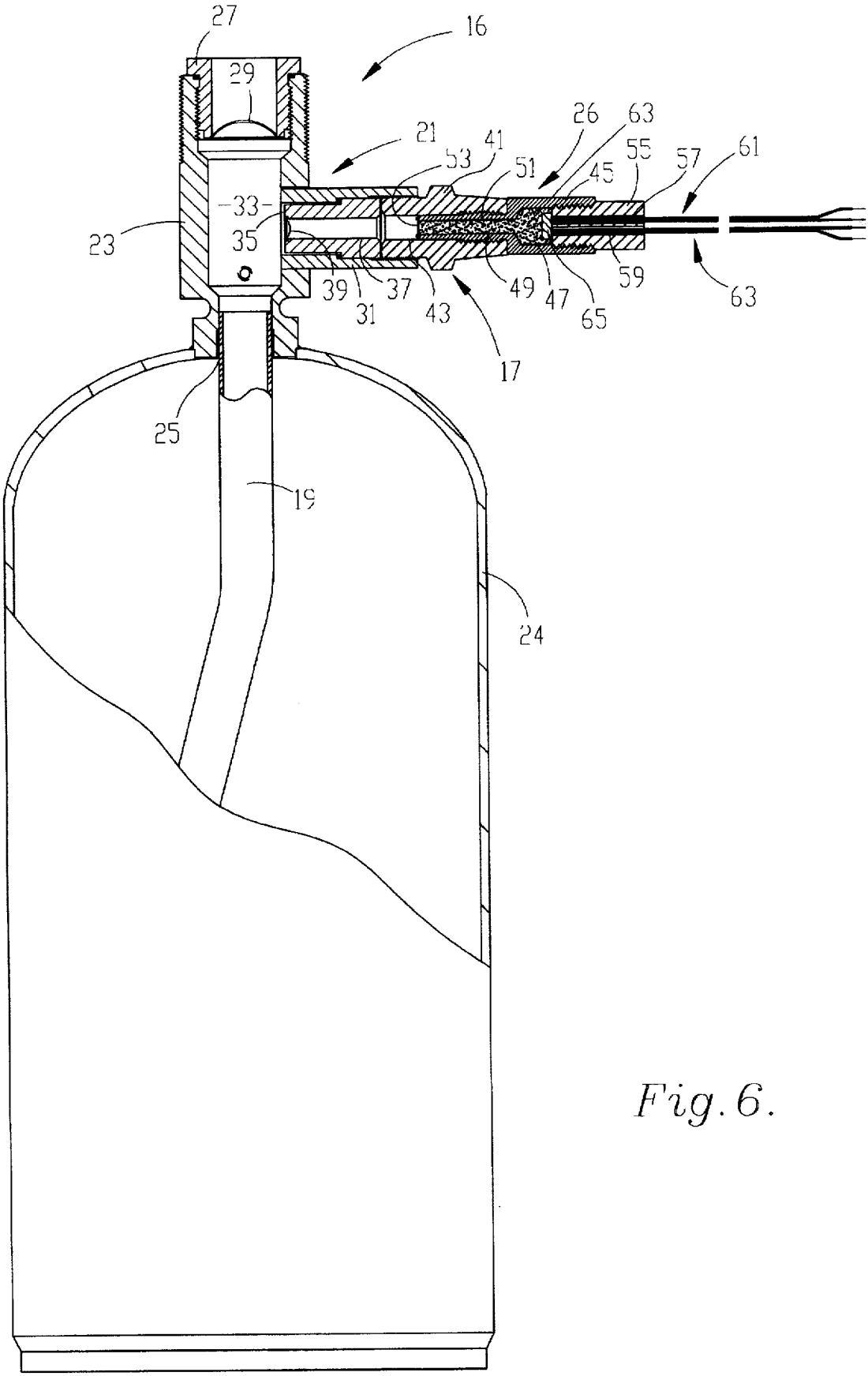
FIG. 6 is a side elevational view of a first preferred embodiment of a fire suppression unit with parts being broken away and in section to reveal the detail of the components thereof, wherein the initiator for opening the rupture disc controlling release of pressurized suppressant from the container therefor consists of a gas-generating cartridge activator.
Figure 7:
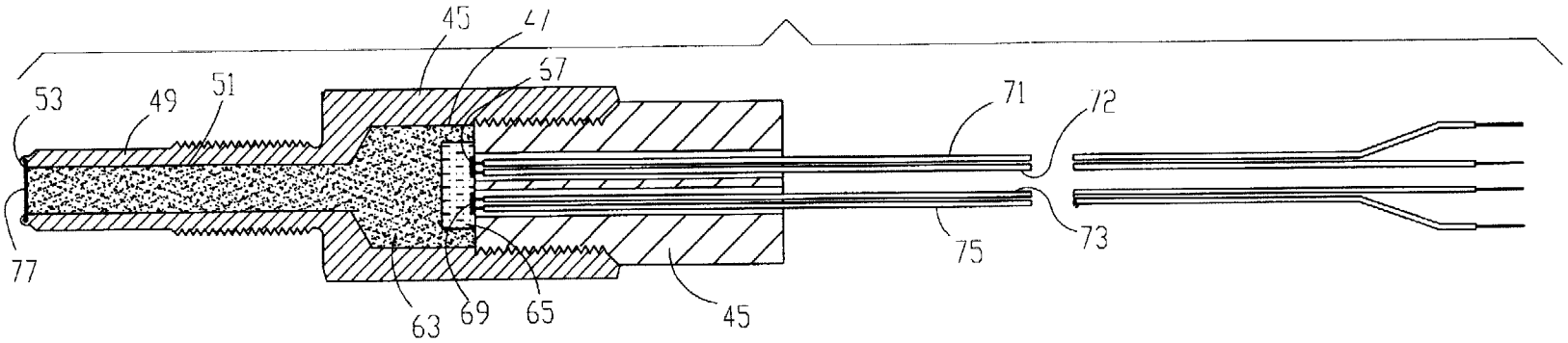
FIG. 7 is an enlarged, cross-sectional view of the cartridge body unit of the activator shown in FIG. 6 and also illustrating the electrical leads for the activator.

FIG. 6 illustrates one of the fire suppressant releasing units 16 as depicted for example in FIG. 1, except that initiator assembly 26 as shown in FIG. 6 comprises a gas-generating cartridge activator 17 for controlling selective release of suppressant under pressure from a respective vessel 24 via a respective tube 19 therein. The initiators 26 are preferably gas cartridge-type initiators such as those manufactured by the Fike Corporation of Blue Springs, Mo. and each as described in detail hereinafter has a pair of separate first and second resistive bridge wire elements within a smokeless powder propellant charge within the cartridge body. In the case of a fire suppression system, the assembly 26 preferably includes a tubular fitting 23 welded to the outlet orifice 25 of vessel 24. A nipple 27 threaded into the outermost end of fitting 23 serves to retain a metal, preferably stainless steel, rupture disc 29 within the outermost end of fitting 23. The preferred rupture disc 29 is of the type manufactured by the Fike Corporation of Blue Springs, Mo., the assignee hereof, and is of the bulged type presenting opposed concavo-convex surfaces. The convex face of the disc 29 is provided with cross scoring so that upon rupture thereof, the disc opens outwardly from the center in the form of four discrete petals, each of which remains attached to the circular rim portion of the disc. Disc 29 is of the non-fragmenting type. Each of the fire suppressant releasing units 16 may also include a dispersion nozzle 27 coupled with its respective container portion 24 for dispersing the suppressant material from its container portion 24 into the protected room 14.

Each initiator 26 is operably coupled with the release valve of its respective container 24 for rupturing the release valves upon receiving an electrical triggering signal from the control panel 20 or the manually activated actuator 10 as described below. If a blasting cap type initiator is employed as the initiator 26, the explosive force therefrom serves to effect rupturing of a corresponding rupture disc closing the discharge fitting of a respective vessel 24. On the other hand, if a gas-generating cartridge is used as the initiator, the smokeless powder within each cartridge body is ignited thereby producing products of combustion which function to rupture their respective release valves when an electrical triggering signal is delivered to either of their bridge wires. It is preferred that the gas-generating cartridge activator be used in fire suppression systems; blasting cap (squib) initiators have been found to be entirely satisfactory for explosion suppression systems, particularly because of the fast response time of such initiators.

The sensing devices 18 are also disposed throughout the protected room 14 and are operable for detecting hazardous conditions within the protected room. The sensing devices 18 are preferably conventional smoke, IR, ion, pressure or UV detectors, similar type sensors, or combinations thereof.

The main control panel 20 is preferably mounted within or near the protected room 14 and is provided for controlling the operation of the other components of the system 12. The control panel 20 is adapted to be coupled with a suitable source of electrical power, such as a 120 volt AC power source, and includes appropriate circuitry for rectifying and reducing the voltage to a suitable control level.

The control panel 20 is electrically coupled with a first one of the bridge wire elements of each of the cartridge type initiators 26, or to respective squibs by conventional wiring carried within a protective conduit 28. The control panel 20 is also electrically coupled with each of the sensing devices 18 by wiring carried within a conduit 30.

When the sensing devices 18 sense a hazardous condition within the protected room 14, they send a signal to or trigger a contact within the main control panel 20. The main control panel 20 responds to the sensing devices 18 by sending a triggering current signal to the first bridge wire elements in each of the cartridge type initiators 26, or to respective squibs, to fire the initiators. As a result, the initiators 26 rupture the rupture discs in their respective fire suppressant releasing units 16, thus releasing the suppressant material from the containers 24 into the protected room 14 to extinguish fires or suppress explosions in the room.

The alarm device 22 may be positioned in or near the protected room 14 and is electrically coupled with the control panel 20 by conventional wiring carried within a protective conduit 32. The alarm device 22 is responsive to the control panel 20 so that it indicates either the sensing of a hazardous condition by the sensing devices 18 or the discharge of the fire suppressant material from the releasing units 16.

The manually operated actuator 10 is preferably positioned in or near the protected room 14 but may also be positioned remote from the room. The actuator 10 is electrically coupled with the second bridge wire elements of the initiators 26 by conventional wiring carried in a protective conduit 34.

As described in more detail below, the actuator 10 provides a manually generated electrical triggering current pulse to the second bridge wire elements in each of the initiators 26 that is completely independent of the triggering signal provided by the main control panel 20. Thus, the manually operated actuator 10 provides a true manual backup to the control panel 20 and the sensing devices 18 so that the fire suppression or explosion protection system 12 is operable even when the control panel or the sensing devices lose power or otherwise fail.

Referring to FIGS. 2–5, the manually operated actuator 10 broadly includes a generator 36, an elongated manually moveable handle 38, and structure generally referred to by the number 40 for operably coupling the handle with the generator. The components of the actuator 10 are preferably mounted and enclosed within an enclosure 42 that includes appropriate instructions printed thereon for instructing persons on how to operate the actuator 10.

Figure 5:
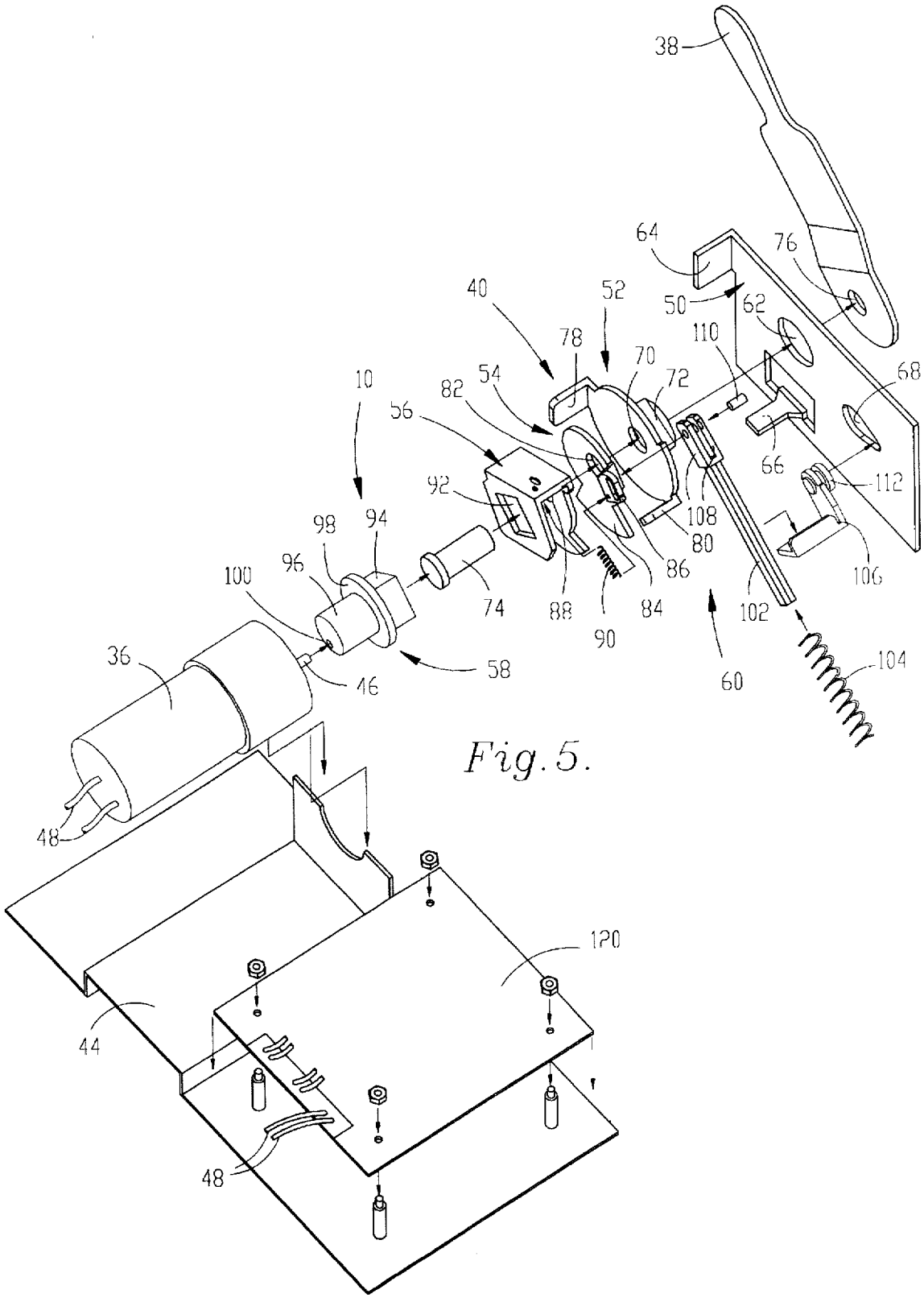
FIG. 5 is an exploded view of certain components of the manually operated actuator.

As best illustrated in FIG. 5, the generator 36 is mounted to a bracket 44 that is bolted or otherwise attached to the inside face of the back wall of the enclosure 42. The generator 36 includes a rotatable shaft 46, an internal armature (not shown) magnetically coupled with the shaft and a pair of wires 48 extending from the armature. The generator 36 is operable for generating a triggering current pulse in the wires 48 for delivery to the second bridge wire elements of each of the initiators 26 when the shaft 46 is rotated.

The preferred generator 36 is a conventional DC motor having an approximately 20:1 gear ratio, a 30.3 VDC winding and wide-face gears such as the GM9414 motor manufactured by the Pittman Corporation. Those skilled in the art will appreciate that the generator 36 may also include other conventional current-generating devices.

The handle 38 is preferably pivotally mounted to the outside face of the right sidewall of the enclosure 42 and is operably coupled with the shaft 46 of the generator 36 by the coupling structure 40 described below. The handle 38 is shiftable between a first, lower, unactivated position depicted in FIG. 2 and a second, upper, activated position depicted in FIG. 4. Those skilled in the art will appreciate that the handle 38 may be positioned on either side of the enclosure, and the direction of travel of the handle may be reversed so that the upper position is the unactivated position. Similarly, the handle 38 and the coupling structure 40 may be configured so that the handle 38 causes the generator 36 to generate an electrical triggering current pulse regardless of which direction the handle is shifted.

The coupling structure 40 operably couples the handle 38 with the shaft 46 of the generator 36 for rotating the shaft at a selected fixed speed when the handle is shifted between its lower and upper positions regardless of the speed at which the handle is shifted and the amount of force exerted on the handle. This permits the generator 36 to generate an electrical current pulse in a selected magnitude range for delivery to the initiators 26 each time the handle 38 is shifted between its lower and upper positions regardless of the strength of the person who operates the actuator.

The selected magnitude of the current pulse generated by the generator 36 is determined by the firing characteristics of the initiators 26. In the case of the cartridge type activators as described herein, the bridge wire elements thereof require a triggering current pulse of at least about 800 milliamps for guaranteed firing under all operating conditions. Accordingly, the coupling structure 40 and the generator 36 are cooperatively configured to generate a triggering current pulse of approximately 800 milliamps for a duration of 5–10 milliseconds. This insures that the cartridge type initiators 26 receive an adequate triggering current pulse to rupture the rupture discs of their respective fire suppressant releasing units 16 whenever a person shifts the handle 38 from its lower position to its upper position.

To obtain a triggering current pulse of approximately 800 milliamps, the preferred coupling structure 40 as well as the handle 38 and enclosure 42 are provided by a No. TG3221 Model 8 safety switch manufactured by the General Electric Corporation. Applicant has discovered that when coupled with the above-described generator 36, the GE safety switch rapidly rotates the shaft 46 of the generator approximately ¼–½ of a rotation within 5–10 milliseconds. Since the preferred generator 36 is a motor with a 20:1 gear ratio, the ¼–½ rotation of the shaft corresponds to approximately 5–10 rotations of the armature, which generates the desired 800 milliamp, 5–10 millisecond triggering current pulse.

Those skilled in the art will appreciate that the coupling structure 40 and the generator 36 may be cooperatively configured to generate a triggering current pulse of any magnitude for any duration by varying the size of the generator 36 and/or the speed at which the handle 38 and coupling structure 40 rotate the shaft of the generator. This allows the present invention to be used with any type of initiator.

As best illustrated in FIG. 5, the preferred coupling structure 40 broadly includes a bracket 50, rotating members 52,54,56, a motor connector 58, and an over-center spring mechanism generally referred to by the numeral 60. The bracket 50 is generally rectangular and is fixedly secured to the inside face of the right sidewall of the enclosure 42 by bolts or other fastening means. The bracket 50 includes a central hole 62, a pair of laterally extending tabs 64,66, and a mounting slot 68. The functions of the hole 62, tabs 64,66 and slot 68 are discussed in connection with the other components of the coupling structure 40 below.

The rotating member 52 is generally circular and includes a central hole 70 and a shortened shaft portion 72 extending from the right side of the bracket. The shaft portion 72 extends through the hole 62 of the bracket 50 and the right sidewall of the enclosure 42. A mounting pin 74 extends through the hole 70, the shaft 72, the hole 62 and a hole 76 formed in one end of the handle 38 for fixedly securing the handle to the rotating member 52 while pivotally coupling the handle to the bracket 50 and the right sidewall of the enclosure 42. The rotating member 52 also includes a pair of axially extending and circumferentially spaced ear sections 78,80 extending from its periphery.

The rotating member 54 is positioned to the left of the rotating member 52 and is also generally circular. The rotating member 54 includes a central hole 82 and a radially extending connection tab 86. The mounting pin 74 is inserted through the hole 82 for rotatably coupling the rotating member 54 adjacent the left face of the rotating member 52. The rotating member 54 also includes an enlarged, radially extending flange portion 84 that is received between the ear sections 78,80 of the rotating member 52 for limiting the travel of the rotating member 54 relative to the rotating member 52.

The rotating member 56 is positioned to the left of the rotating member 54 and includes a pair of axially spaced-apart faces and an interconnecting bight section. The mounting pin 74 is inserted through a hole 88 formed in the right face of the rotating member 56 for rotatably coupling the rotating member 56 adjacent the rotating members 54,52. The rotating member 56 is also connected to the connection tab 86 of the rotating member 54 by a small spring 90 so that the rotating member 56 follows the movement of the rotating member 54. The left face of the rotating member 56 includes a generally square-shaped hole 92 formed therein.

The motor connector 58 is coupled between the shaft 46 of the generator 36 and the left face of the rotating member 56 for transferring the rotation of the rotating member 56 to the shaft. The motor connector 58 includes a generally square-shaped shaft portion 94, a generally circular shaft portion 96 and an interconnecting flange portion 98. The shaft portion 94 is received within the opening 92 of the left face of the rotating member 56. The shaft portion 96 has a hole 100 formed therein that is received over the shaft 46 of the generator 36.

The over-center spring mechanism 60 is operably coupled between the rotating member 54 and the bracket 50. As described in more detail below, the spring mechanism 60 temporarily stores a portion of the mechanical force exerted on the handle 38 when the handle is shifted between its lower and upper positions and subsequently rapidly delivers the stored force to the rotating member 54 for delivery to the shaft 46 of the generator 36 for generating the triggering current pulse described above.

The spring mechanism 60 includes an elongated rod 102, an elongated coil spring 104 positioned over the length of the rod, and an L-shaped mounting bracket 106 pivotally coupled to the bracket 52. The upper end of the rod 102, as viewed from FIG. 5, includes a pair of spaced-apart upstanding ear sections 108 that are positioned around and pivotally connected to the connection tab 86 of the rotating member 54 by a connection pin 110.

The vertically extending portion of the L-shaped mounting bracket 106 is pivotally coupled within the mounting slot 68 of the bracket by a pin 112. As best illustrated in FIG. 2, the horizontally extending portion of the bracket 106 has a slot 114 formed therein.

The lower end of the rod 102 is slidingly received within the slot 114 of the bracket 106. When the rotating member 54 is rotated as described below, the upper end of the rod 102 pivots on the connection tab 86 relative to the rotating member 54 while the lower end of the rod 102 and the L-shaped mounting bracket 106 pivot relative to the bracket 50. This causes the lower portion of the rod 102 to slide in and out of the slot 114 in the mounting bracket 106.

In operation, the handle 38 is initially positioned in its first, lower, unactivated position as illustrated in FIG. 2. Then, whenever a person senses a hazardous condition in the protected room 14, the person shifts the handle 38 upwards as illustrated by the arrow 116.

While the handle 38 is being shifted upwards, it rotates the rotating member 52 counterclockwise as viewed from FIGS. 2–5. After the rotating member 52 rotates a short distance, its first ear section 78 engages the adjacent side of the flange portion 84 of the rotating member 54 and rotates the rotating member 54 along with the handle 38.

The connection tab 86 on the rotating member 54 in turn pivots and shifts the elongated rod 102 downward so that the lower portion of the rod slides through the slot 114 formed in the mounting bracket 106. This compresses the spring 104 positioned over the rod 106 and thus stores a portion of the mechanical energy exerted on the handle 38 in the spring. During this movement, the upper portion of the elongated rod 102 pivots about the connection tab 86 and the lower portion of the elongated rod and the mounting bracket 106 pivot relative to bracket 50 towards their center positions.

Once the handle 38 is shifted to the position illustrated in FIG. 3, the over-center spring mechanism 60 is near its center point and the spring 104 is fully compressed. Thus, the spring mechanism 60 is storing its maximum amount of mechanical force.

Then, when the person shifts the handle 38 further upwardly as illustrated by the arrow 118 in FIG. 3, the over-center spring mechanism 60 shifts over its center position. This permits the spring 104 to expand as illustrated in FIG. 4 and to transfer its stored energy to rotating members 54,56 to rotate the rotating members. The rotating member 56 in turn rotates the motor connector 58, which is coupled with the shaft 46 of the generator 36, causing the shaft to rotate. This generates the triggering current pulse in the armature of the generator 36, which is delivered to the second bridge wire elements of the initiators 26 by wiring 122 connected to the output wires 48 of the generator.

Once the handle 38 has been shifted to its upper, activated position, the actuator 10 may be reset by merely shifting the handle back to its lower, unactivated position as illustrated by the arrow 126 depicted in FIG. 4.

The manually operated actuator 10 may also include a supervision module 120 electrically coupled between the output wires 48 of the generator 36 and the wiring 122 leading to the initiators 26. An example of a supervision module that may be used with the present invention is described in detail in U.S. Pat. No. 4,199,029, which is incorporated herein by reference.

The supervision module 120 delivers the triggering current pulse generated by the generator 36 to the initiators 26 over the wires 122. The supervision module 120 is also electrically coupled with the main control panel 20 by a pair of wires 124. The supervision module 120 receives a 24 volt signal from the control panel 20 over the wires 124 and delivers a small supervisory current of approximately 200 milliamps or less to the second bridge wire elements of the initiators 26 over the wires 122. This supervisory current, which is too low to fire the initiators 26, is used to detect wiring failures such as open or short circuits in the bridge wire elements or the wiring 122.

Returning to FIG. 6, it is to be seen that an internally threaded cross nipple 31 is affixed to fitting 23, communicates with the passage 33 therethrough, and thereby forms a part of fitting 23. A sleeve member 35 is positioned within the interior of nipple 31 and has an open-ended, longitudinally extending bore 37 therethrough. A metal, preferably stainless steel, inwardly-domed, cross scored rupture disc 39 closes the end of bore 37 in closest proximity to passage 33. A tubular connector 41 is threaded into the outermost end of nipple 31 and directly contacts sleeve member 35 to retain the latter in the position thereof shown in FIG. 6. Connector 41 has an elongated bore 43 of approximately the same diameter as bore 37.

Gas-generating cartridge type activator 17 is coupled directly to connector 41. The activator 17 includes a main body unit 45 provided with an internal propellant-receiving chamber 47. The integral elongated tubular extension 49 of activator 17 has a bore 51 which communicates at one end with chamber 47 and at the opposite extremity with the discharge end 53 of body 45. An end fitting 55 is threaded into the internally-threaded extremity of body unit 45 opposed to extension 49 and is provided with two parallel elongated passages 57 and 59 therein for receiving electrical control leads broadly designated 61 and 63, respectively.

Figure 8:
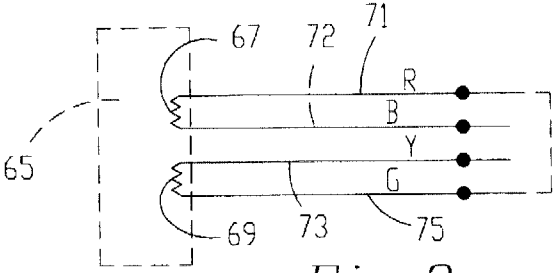
FIG. 8 is a schematic representation of the wires connected to the activator of FIG. 7.
Figure 9:
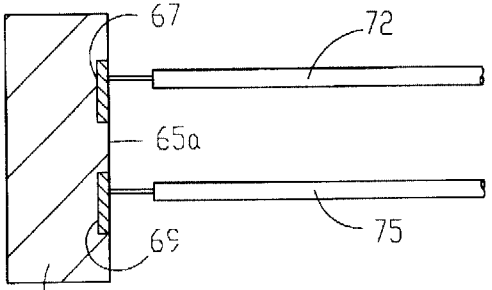
FIG. 9 is an essentially schematic, cross-sectional view of the ignitor disc that is embedded in the smokeless powder granules contained in the cartridge body unit of the activator and that is connected to the electrical leads extending from the control panel or manual actuator of the preceding figures.
Figure 10:
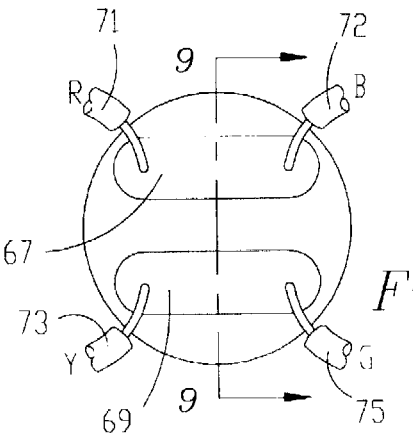
FIG. 10 is a schematic plan view of the rear of the ignitor disc shown in FIG. 9.

Chamber 47 of main body unit 45 as well as bore 51 of extension 49 contain a quantity of a solid propellant 63, preferably comprising granules of smokeless powder. In addition, a disc 65 of an ignition mix is located within chamber 47 adjacent the innermost face of end fitting 55. As is most evident from FIGS. 9 and 10, disc 65 is provided with two bridge wire elements 67 and 69 comprising relatively thin metal plates each having a resistance of about 0.75 ohms, approximately 0.002 in thickness, and spaced from one another about 0.08 inch (2 mm). The bridge elements 67 and 69 are located within disc 65 adjacent the normally rearmost face **65*a* thereof. The electrical control leads are connected to bridge elements 67 and 69 as shown for example in FIG. 8. The R and B leads 71 and 72 are welded to opposite ends of bridge elements 67; the Y and G leads 73 and 75 are welded to opposite ends of bridge element 69**.

A non-fragmenting, consumable closure disc 77 is mounted across the discharge end 53 of extension 49 in sealing relationship thereto. Preferably, disc 77 comprises a thin circular Mylar element which protects the smokeless powder charge 63 and ignition disc 65 from exposure to the atmosphere surrounding activator 17 not only during distribution and storage of the latter before use, but also while activator 17 is in place within connector 41.

The propellant charge 63 is made up of a quantity of smokeless powder granules of a conventional formulation comprising an admixture of nitroglycerin, nitrocellulose, and lead thiocyanate. The formulation preferably has an auto-ignition temperature no greater than about 325° F. and has a DOT classification of 1.4s and a UN classification of 0323.

The propellant charge 63 should contain a sufficient quantity of smokeless powder to generate adequate gaseous products of combustion at a pressure sufficient to effect rupture of disc 39 and main rupture disc 29 to thereby release the heptafluropropane suppressant from associated container 24. It has been found in this respect that a propellant charge of at least about 1650 mg. of smokeless powder is preferred. Likewise, the ignition mix making up disc 65 is preferably an explosive composition comprising primarily of potassium perchlorate, and is about 0.02 inch thick with a diameter of about ⅜- to ½ inch.

Upon delivery of a minimum 800 milliamp current to either bridge element 67 or bridge element 69 from the system control panel 20 or manual actuator 10, the ignition disc 65 is activated thereby igniting the smokeless powder charge 63. By virtue of the fact that charge 63 is made up of a quantity of granular smokeless powder, ignition of the powder produces hot products of combustion which volatilize the Mylar disc 77 and are then ejected from main body unit 45 via discharge end 53 for passage along bores 43 and 37. Disc 39 is immediately ruptured, allowing the products of combustion to flow into passage 33 thereby rupturing disc 29 and allowing the pressurized suppressant within container 24 to flow outwardly through nipple 27 via tube 19. The suppressant medium is then delivered to respective nozzles overlying the combustion event as sensed by the sensors 18. Utilization of smokeless powder as the propellant medium for activator 17 has the advantage of producing adequate products of combustion to quickly open the rupture disc 29 and release the suppressant from container 24 without a concomitant explosion as in the case of a squib. Furthermore, the relatively slow burning smokeless powder produces hot products of combustion but the pressures created thereby are not sufficient to rupture main body unit 45 of the activator 17. At the same time, the rupture discs 39 and 29 open but do not fragment, and Mylar disc 39 is completely consumed by the hot gasses. As a consequence, no metal or other dangerous fragments are created which could move downstream along with the suppressant medium to the area protected by the suppressant system.

FIG. 11 illustrates a suppressant container and delivery unit which has been found to be especially useful for explosion suppression applications. The container 24 of FIG. 4 receives a quantity of the pressurized suppressant agent which is retained in the container by a rupture disc 25. A nozzle and cover assembly 79 is provided in overlying relationship to rupture disc 25. The initiator 26 may either be a squib device as previously described, or a cartridge type initiator such as activator 17. Operation of the suppressant unit shown in FIG. 11 is identical to that described with respect to the suppressant unit of FIG. 6 in the instance of a cartridge type gas generator such as activator 17, or upon ignition of a squib device within the main tube of the initiator 26 as depicted in that figure.

Although the invention has been described with reference to the preferred embodiment illustrated in the attached drawing figures, it is noted that equivalents may be employed and substitutions made herein without departing from the scope of the invention as recited in the claims. For example, although the manually operated actuator 10 is preferably used in connection with a fire suppression or explosion protection system 12, those skilled in the art will appreciate that it may also be used to deliver a manually generated triggering pulse or signal to electrically responsive devices in other types of systems that require a triggering signal.

We claim:

1. A manually operated actuator for triggering an electrically responsive device, the actuator comprising:

generating means, including a shaft, for generating a current for delivery to the device when the shaft is rotated;

a manually moveable handle shiftable between first and second positions at any desired speed; and means operably coupling the handle with the shaft for rotating the shaft at a selected speed when the handle is shifted between the first and second positions regardless of the speed at which the handle is shifted for generating a current pulse in a selected magnitude range for delivery to the device for triggering the device.

2. The actuator as set forth in claim 1, the coupling means including a spring mechanism operably coupled with the shaft, means operably coupling the spring with the handle for compressing the spring when the handle is shifted from its first position towards its second position for storing the mechanical force exerted on the handle in the spring, and triggering means for triggering the compressed spring to expand when the handle approaches its second position for delivering the force stored in the spring to the shaft for rotating the shaft at the selected speed.

3. The actuator as set forth in claim 2, the spring mechanism including an over-center spring mechanism.

4. The actuator as set forth in claim 1, the generating means including a DC motor.

5. The actuator as set forth in claim 1, the generating means including a DC generator.

6. The actuator as set forth in claim 1, the current pulse generated by the generator means having a magnitude of at least about 800 milliamps and a duration of approximately 5–10 milliseconds.

7. The actuator as set forth in claim 1, the electrically responsive device including an initiator in a fire suppression or explosion protection system.

8. A manually operated actuator for triggering an electrically responsive initiator in a fire suppression or explosion protection system, the actuator comprising:

generating means, including a shaft, for generating a current for delivery to the initiator when the shaft is rotated; and a manually moveable handle shiftable between first and second positions and operably coupled with the shaft for rotating the shaft when the handle is shifted between the first and second positions for generating a current for delivery to the initiator for triggering the initiator.

9. The actuator as set forth in claim 8, further including means operably coupling the handle with the shaft for rotating the shaft at a selected speed when the handle is shifted between the first and second positions regardless of the speed at which the handle is shifted for generating a current pulse in a selected magnitude range for delivery to the device for triggering the device.

10. The actuator as set forth in claim 9, the coupling means including spring mechanism operably coupled with the shaft, means operably coupling the spring with the handle for compressing the spring when the handle is shifted from its first position towards its second position for storing the mechanical force exerted on the handle in the spring, and triggering means for triggering the compressed spring to expand when the handle approaches its second position for delivering the force stored in the spring to the shaft for rotating the shaft at the selected speed.

11. The actuator as set forth in claim 10, the spring mechanism including an over-center spring mechanism.

12. The actuator as set forth in claim 8, the initiator including a gas-generating cartridge activator.

13. A fire and explosion suppression system for suppressing fires and explosions in a room, the system comprising:

at least one container having pressured suppressant material stored therein and located in the room, the container including a release valve for holding the suppressant material in the container;

an electrically responsive initiator operably coupled with the release valve for opening the release valve upon receiving a triggering current signal; and a manually operated actuator for triggering the initiator, the actuator including generating means, including a shaft, for generating the triggering current signal for delivery to the initiator when the shaft is rotated; and a manually moveable handle shiftable between first and second positions and operably coupled with the shaft for rotating the shaft when the handle is shifted between the first and second positions for causing the generating means to generate the triggering current signal.

14. The actuator as set forth in claim 13, further including means operably coupling the handle with the shaft for rotating the shaft at a selected speed when the handle is shifted between the first and second positions regardless of the speed at which the handle is shifted for generating a current pulse of a selected magnitude for delivery to the device for triggering the device.

15. The actuator as set forth in claim 14, the coupling means including spring mechanism operably coupled with the shaft, means operably coupling the spring with the handle for compressing the spring when the handle is shifted from its first position towards its second position for storing the mechanical force exerted on the handle in the spring, and triggering means for triggering the compressed spring to expand when the handle approaches its second position for delivering the force stored in the spring to the shaft for rotating the shaft at the selected speed.

16. The actuator as set forth in claim 15, the spring mechanism including an over-center spring mechanism.

17. The actuator as set forth in claim 13, the initiator including a gas-generating cartridge activator.

* * * * *